US006253824B1

(12) United States Patent
Mullet et al.

(10) Patent No.: US 6,253,824 B1
(45) Date of Patent: Jul. 3, 2001

(54) DISCONNECT FOR POWERED SECTIONAL DOOR

(75) Inventors: Willis J. Mullet, Pensacola Beach; Kelly R. Green, Pace; Harry E. Asbury, Gulf Breeze, all of FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/255,961

(22) Filed: Feb. 23, 1999

(51) Int. Cl.[7] ..... E05F 15/00

(52) U.S. Cl. ..... 160/188; 160/201; 192/69.7; 192/89.27; 192/995; 192/101; 74/625

(58) Field of Search ..... 160/188, 189, 160/201, 191, 192, 190, 310; 192/89.27, 69.7, 101, 995; 49/139; 74/625

(56) References Cited

U.S. PATENT DOCUMENTS

| | | | | |
|---|---|---|---|---|
| 1,860,636 | * | 5/1932 | Tibbetts | 192/89.27 |
| 2,318,328 | * | 5/1943 | Nallinger | 192/89.27 |
| 2,426,023 | * | 8/1947 | Jeppesen et al. | 192/69.7 |
| 2,444,148 | * | 6/1948 | Warwick | 192/69.7 |
| 3,106,275 | * | 10/1963 | Chambers | 192/89.27 |
| 3,134,273 | * | 5/1964 | Wardlaw | 74/625 |
| 4,085,629 | | 4/1978 | Fogarollo | 74/625 |
| 4,098,023 | | 7/1978 | Slopa | 49/139 |
| 4,443,033 | | 4/1984 | D'Anna | 292/235 |
| 4,472,910 | | 9/1984 | Iha | 49/139 |
| 4,519,487 | * | 5/1985 | Florin | 74/625 |
| 4,618,174 | | 10/1986 | Duke | 292/135 |
| 4,702,361 | * | 10/1987 | Banks | 192/99 S |
| 4,852,706 | | 8/1989 | Pietrzak et al. | 192/8 R |
| 4,884,831 | | 12/1989 | Emon | 292/38 |
| 4,993,533 | | 2/1991 | Brown | 192/114 R |
| 5,083,600 | | 1/1992 | Weishar | 160/310 |
| 5,509,233 | | 4/1996 | Peterson | 49/139 |
| 5,557,887 | | 9/1996 | Fellows et al. | 49/28 |
| 5,560,432 | * | 10/1996 | Conte | 192/69.7 |
| 5,581,939 | * | 12/1996 | Regan et al. | 49/139 |
| 5,698,073 | | 12/1997 | Vincenzi | 160/188 |
| 5,931,212 | * | 8/1999 | Mullet et al. . | |
| 5,975,185 | * | 11/1999 | Miller et al. | 74/625 |

FOREIGN PATENT DOCUMENTS

| | | | |
|---|---|---|---|
| WO 99/04124 | 1/1999 | (WO) | E05F/15/16 |

* cited by examiner

*Primary Examiner*—Blair M. Johnson
(74) *Attorney, Agent, or Firm*—Renner, Kenner, Greive, Bobak, Taylor & Weber

(57) ABSTRACT

An operator (10) for moving in upward and downward directions a sectional door (D) having a counterbalancing system (30) including a drive tube (31) interconnected with the door including, a reversible motor (40), a drive shaft (50) selectively driven in two directions by the motor, a drive gear (61) freely rotatably mounted on the drive shaft, a driven gear (65) mounted on the drive tube and operatively engaging the drive gear, a disconnect assembly (70) having a spool (71) rotatable with the drive shaft and movable into and out of engagement with the drive gear for selectively connecting and disconnecting the motor and the drive tube, and an actuating mechanism (80) normally maintaining said spool in engagement with the drive gear and biasing the spool out of engagement with the drive gear when released to permit independent movement of the door.

24 Claims, 5 Drawing Sheets

DISCONNECT FOR POWERED SECTIONAL DOOR

TECHNICAL FIELD

The present invention relates generally to motorized operators for sectional doors. More particularly, the present invention relates to jack-shaft operators employed for the powered operation of sectional doors. More specifically, the present invention relates to a disconnect for selectively connecting and disconnecting a jack-shaft operator to a counterbalance system connected to and adapted to operatively position a sectional overhead door.

BACKGROUND ART

Motorized apparatus for opening and closing sectional overhead doors has long been known in the art. These powered door operators were developed in part due to extremely large, heavy commercial doors for industrial buildings, warehouses, and the like where the opening and closing of the doors essentially mandated power assistance. Eventually, homeowner demands for the convenience and safety of door operators, particularly when remote actuation became readily feasible, resulted in an extremely large market for powered door operators for residential applications.

The vast majority of motorized operators for residential garage door applications employ a trolley-type system extending perpendicular to the door header into the garage to apply force to a section, normally the upper section, of the door for powering between the open and closed positions. Another type of motorized operator is known as a "jack-shaft" operator, which is used extensively in commercial applications and is so named by virtue of similarities with transmission devices where the power or drive shaft is parallel to the driven shaft, with the transfer of power occurring mechanically as by gears, belts, or chains interconnecting the drive shaft and a driven shaft, which controls the position of a door.

The extensively employed door operators that connect directly to the garage door, principally the trolley-type systems, traditionally have a manual disconnect that at any time disconnects the operator from its mechanical interconnection with the door. These disconnects are usually incorporated into the trolley portion of the operator in such a fashion that when disconnected, the door is free to be manually moved in either the open or closed direction. This type of disconnect for trolley-type operators permit a person to isolate the arm interconnecting the door and the trolley in the event the operator or the door malfunctions, there is a loss of power to the operator, or the door entraps a person or object. A disconnect of this general type has been a mandatory requirement for trolley-type garage door operators for a number of years.

The disconnect handle on trolley-type operators is normally attached to a rope that is suspended from, and moves with, the trolley as the operator opens and closes the garage door. There are industry requirements that a handle be at the bottom of the rope suspended from the trolley and be suspended no more than six feet from the floor so that it is available to be grasped by a person and pulled to effect disconnect in the event of an emergency.

These positioning requirements coupled with the basic characteristics of a trolley-type system create serious disadvantages in some operating conditions. The fact that the rope and disconnect handle move with the trolley may undesirably make it difficult to locate the handle at night or in a dark garage when there is a power failure. In addition, the movement of the rope suspended handle into and out of the garage during opening and closing of the door can result in the handle dragging across the top of high vehicles and even becoming entangled in a luggage rack or other appurtenances that may be roof-mounted on vans or sports utility vehicles. It is also to be observed that when a garage door is closed, the disconnect rope and handle are in the closest proximity to the garage door. When the door has windows positioned in the top section of the door, as is customary, the security of the garage in regard to breaking and entering is seriously compromised. In such instance, if the center window pane is broken, the disconnect handle is within easy reach for an intruder to disconnect the door from the operator and subsequently manually open the door to the garage.

Most of the commercially-employed disconnects for trolley-type operators are weighted or spring-loaded toward the connected position, such that these biasing forces must be overcome to disengage the disconnect so the door can be moved independent of the trolley. This biasing allows the disconnect to automatically re-engage when the door is manually moved to the precise position where disengagement was effected by the disconnect. In some instances, disconnects automatically engage when the trolley is moved by the operator motor to the appropriate position for a current door location. While automatic engaging features are sometimes considered to be advantageous, in other instances a disconnect that engages only when a positive manual action, such as moving a handle or lever, is taken is preferred. While it is generally conceded to be highly advantageous to engage a disconnect at any location of the door and operator without adjusting the position of either, such an operational format is not possible with current trolley-type operator designs.

In relation to jack-shaft operators, the operator units are normally mounted on the side of the door outwardly of the rails, which can produce clearance problems in the instance of minimal clearance between a garage side wall and the rails for the door rollers. Whether of a vertical open position type door as is employed in commercial installations where there is substantial building height or a horizontal open position type door, as is necessary for most residential installations, disconnection of the motor and the door is normally effected by a rope and handle suspended either from the operator unit or by a lever or actuating arm located on the operator. In residential applications where there are top section windows, such disconnects are subject to forced entry by breaking an end window and merely pulling the disconnect handle or the disconnect lever. In instances where a jack-shaft operator may be mounted above the door, a serious operational deficiency is encountered in efforts to effect disconnect when the door is at an intermediate position because the portion of the door extending horizontally into the garage renders the operator and its disconnect mechanism above the door inaccessible in virtually all instances, except when the door is in the fully closed position. Thus, existing disconnects suffer from one or more disadvantageous characteristics.

DISCLOSURE OF THE INVENTION

Therefore, an object of the present invention is to provide a motorized operator for a sectional door that is a type of jack-shaft operator with a mechanical disconnect. Another object of the present invention is to provide such a motorized operator which does not mechanically disconnect the operator from the door but rather, separates the motor drive for the operator from the door counterbalance system. A further object of the present invention is to provide such a motorized operator that does not have a moving disconnect handle that travels with the door, does not directly mechanically interconnect to the door, and otherwise eliminates various disadvantageous operational characteristics common to trolley-type operators.

Another object of the present invention is to provide a motorized operator for sectional doors that does not require pulling a cable to effect mechanical disconnection, such that a person seeking to achieve unauthorized entry as through a broken glass pane in the door cannot achieve entry by merely pulling an accessible cable. A still further object of the invention is to provide such a mechanical disconnect wherein pulling or further tensioning of the actuating cable of the disconnect mechanism serves to reinforce the engagement of the disconnect in the operating position, thereby precluding unauthorized entry. Yet a further object of the invention is to provide such a motorized operator wherein the cable-mounted handle actuating the disconnect may be remotely placed and requires release of the handle from a retaining bracket to achieve the disconnect function.

Still another object of the present invention is to provide a motorized operator for sectional doors that requires only the pulling of a cable-suspended handle to connect the manual disconnect for normal motorized operation of the door. Still another object of the present invention is to provide such a motorized operator that does not require returning the door to the position at which the disconnect was disengaged to effect re-engagement in that re-engagement may be accomplished at any position of the door. Yet another object of the invention is to provide such a motorized operator that will not automatically re-engage once it is disengaged without pulling actuation of an operator handle and effecting tensioned positioning on a retaining bracket.

A further object of the present invention is to provide a motorized operator for sectional doors that can be quickly and easily installed and has a disconnect assembly that may be quickly and easily positioned, which requires few adjustments and is operatively sufficiently simple, such as to provide a high degree of reliability. Still a further object of the invention is to provide such a motorized operator that is designed to be installed such that it does not require additional headroom above a torsion spring counterbalance system mounted relative to the door or outside of the vertical tracks, except for the remote mounting of an operator disconnect handle and retaining bracket, which may be advantageously intentionally displaced a distance from the door.

In general, the present invention contemplates an operator for moving in upward and downward directions a sectional door having a counterbalancing system including, a drive tube interconnected with the door including, a reversible motor, a drive shaft selectively driven in two directions by the motor, a drive gear freely rotatably mounted on the drive shaft, a driven gear mounted on the drive tube and operatively engaging the drive gear, a disconnect assembly having a spool rotatable with the drive shaft and moveable into and out of engagement with the drive gear for selectively connecting and disconnecting the motor and the drive tube, and an actuating mechanism normally maintaining the spool in engagement with the drive gear and biasing the spool out of engagement with the drive gear when released to permit independent movement of the door.

PREFERRED EMBODIMENT FOR CARRYING OUT THE INVENTION

Figure 1:
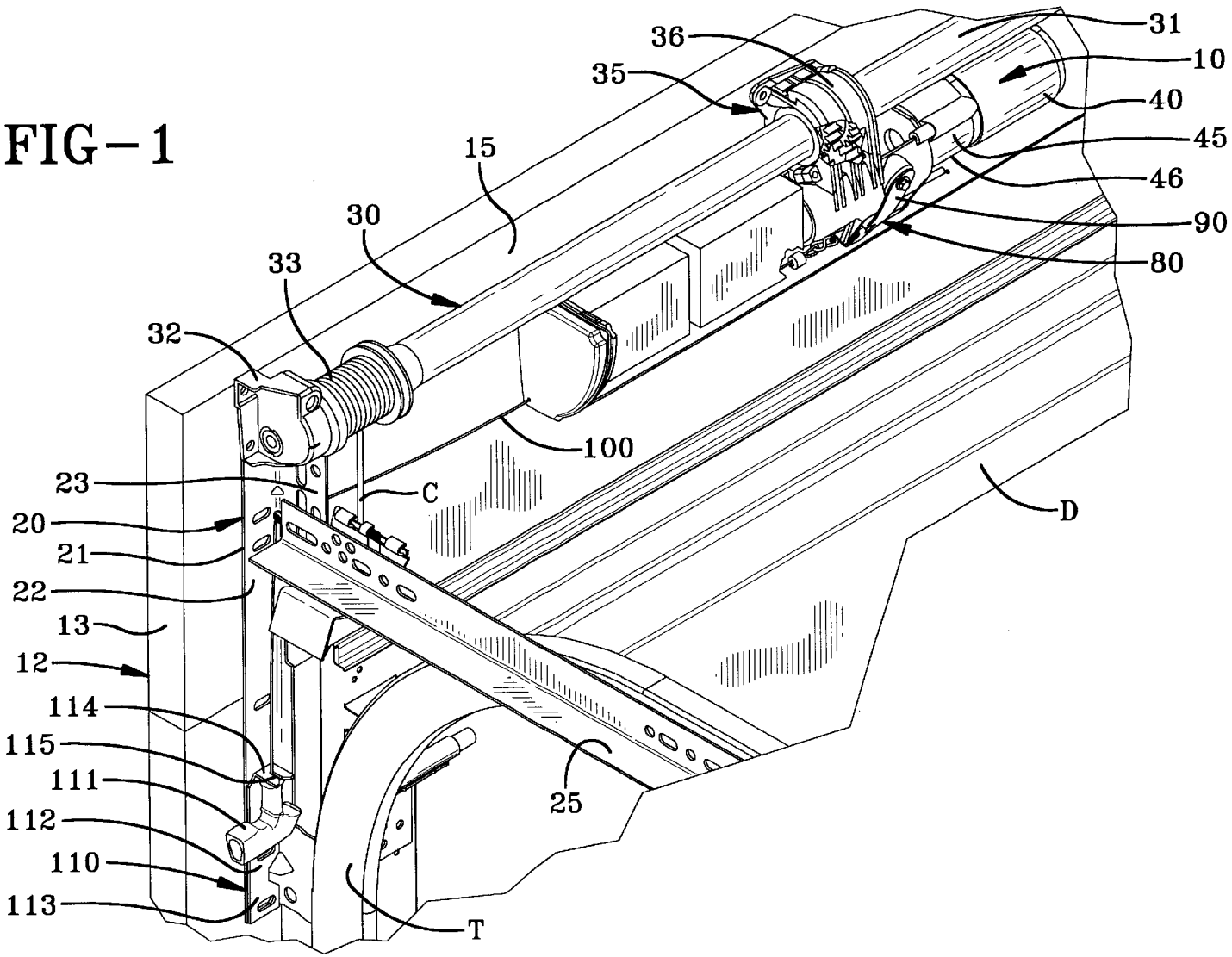
FIG. 1 is a fragmentary rear perspective view of a sectional overhead garage door installation having a torsional counterbalancing system connected to the door and to a motorized operator with a disconnect assembly according to the concepts of the present invention.

A motorized operator according to the concepts of the present invention is generally indicated by the numeral 10 in the drawing figures. The motorized operator 10 is shown mounted in conjunction with a conventional sectional door D of a type commonly employed in garages for residential housing, as seen particularly in FIGS. 1–3. The opening in which the door D is positioned for opening and closing movements relative thereto is conventionally defined by a frame, generally indicated by the numeral 12, which consists of spaced jambs 13 that are generally parallel and extend vertically upward from a garage floor. The jambs 13 are spaced and joined at their vertically upper extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the motorized operator 10.

Affixed to the jambs 13 proximate the upper extremities thereof and the lateral extremities of the header 15 to either side of the door D are flag angles, generally indicated by the numeral 20. The flag angles 20 generally consist of L-shaped members 21 having a leg 22 attached to an underlying jamb 13 and a projecting leg 23 preferably disposed substantially perpendicular to the leg 22 and, therefore, perpendicular to the jambs 13.

Flag angles 20 also include an angle iron 25 positioned in supporting relation to tracks T located to either side of the door D. The tracks T provide a guide system for rollers attached to the sides of door D in a manner well known to persons skilled in the art. The angle irons 25 normally extend substantially perpendicular to the jambs 13 and may be attached to the transitional portion of tracks T between the vertical section and horizontal section thereof or at the commencement of the horizontal section of tracks T. In conventional fashion, the tracks T define the travel of the door D in moving upwardly from the closed vertical position to the open horizontal position and downwardly from the open horizontal position to the closed vertical position.

The motorized operator 10 mechanically interrelates with the door D through a counterbalance system, generally indicated by the numeral 30. As shown, the counterbalance system 30 includes an elongate drive tube 31 extending between tensioning assemblies 32 positioned proximate each of the flag angles 20. While the counterbalance system 30 depicted herein is advantageously in accordance with that disclosed in Applicants' assignee's U.S. Pat. No. 5,419,010, it will be appreciated by persons skilled in the art that motorized operator 10 could be employed with a variety of torsion spring counterbalance systems. In any instance, the counterbalance system 30 includes cable drum mechanisms 33 positioned on the drive tube 31 proximate the ends thereof, which rotate with the drive tube 31.

The cable drum mechanisms 33 each have a cable C reeved thereabout which extend downwardly and are affixed to the door D, preferably proximate the bottom, such that rotation of the cable drum mechanisms 33 operates to open and close the door D in accordance with conventional practice. While drive tube 31 is a hollow, tubular member that is non-circular in cross-section, it is to be appreciated that circular drive tubes, solid shafts, and other types of driving elements that rotate cable drums, such as cable drum mechanisms 33, may be employed in conjunction with the motorized operator 10 of the invention and are encompassed within this terminology in the context of this specification.

Figure 2:
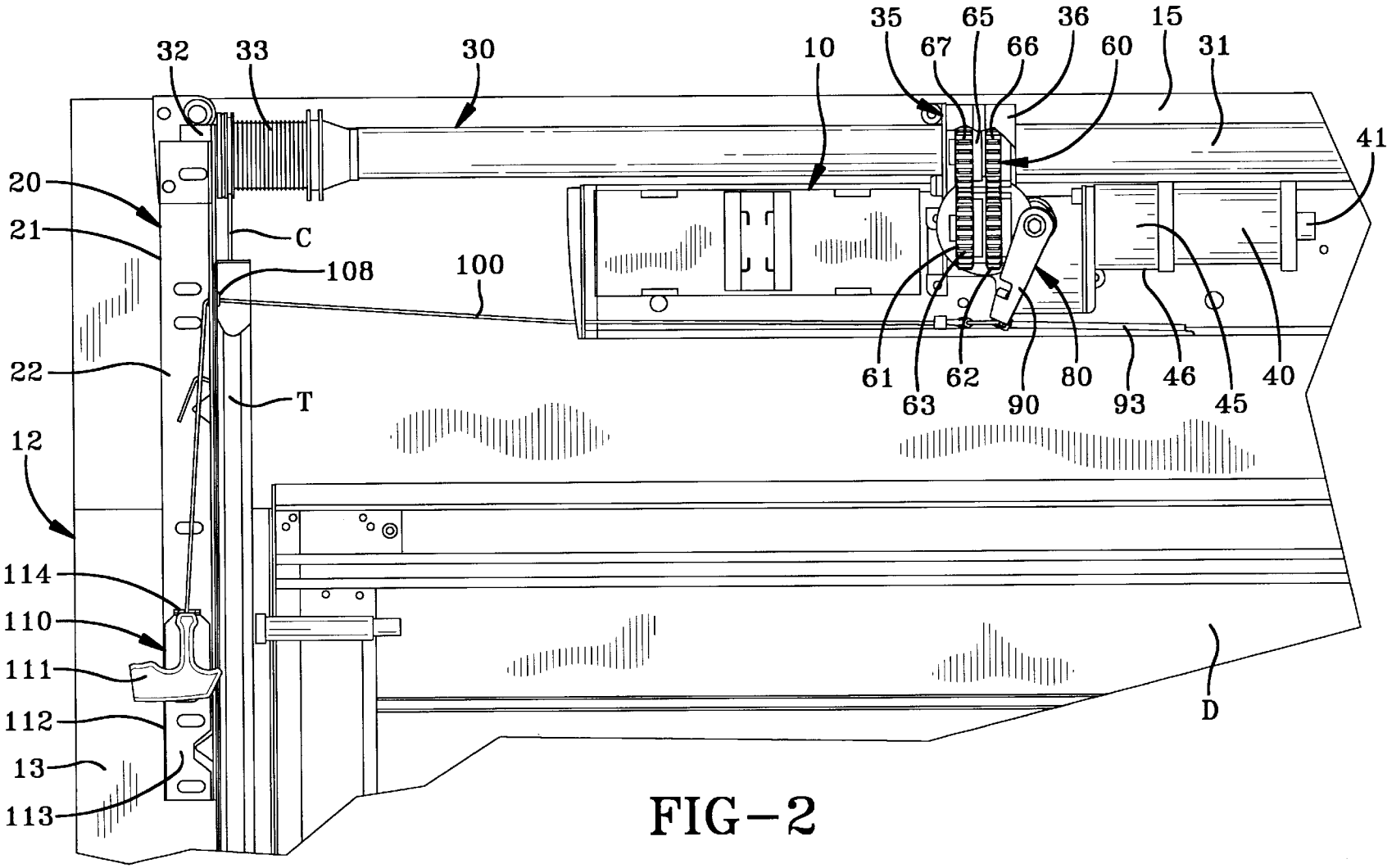
FIG. 2 is a fragmentary rear elevational view of the door, counterbalancing system, and motorized operator of FIG. 1 with a portion of the operator housing broken away to show the interconnection between the operator and the counterbalancing system and details of the disconnect assembly in its normal operating position with the operator driving the door.
Figure 3:
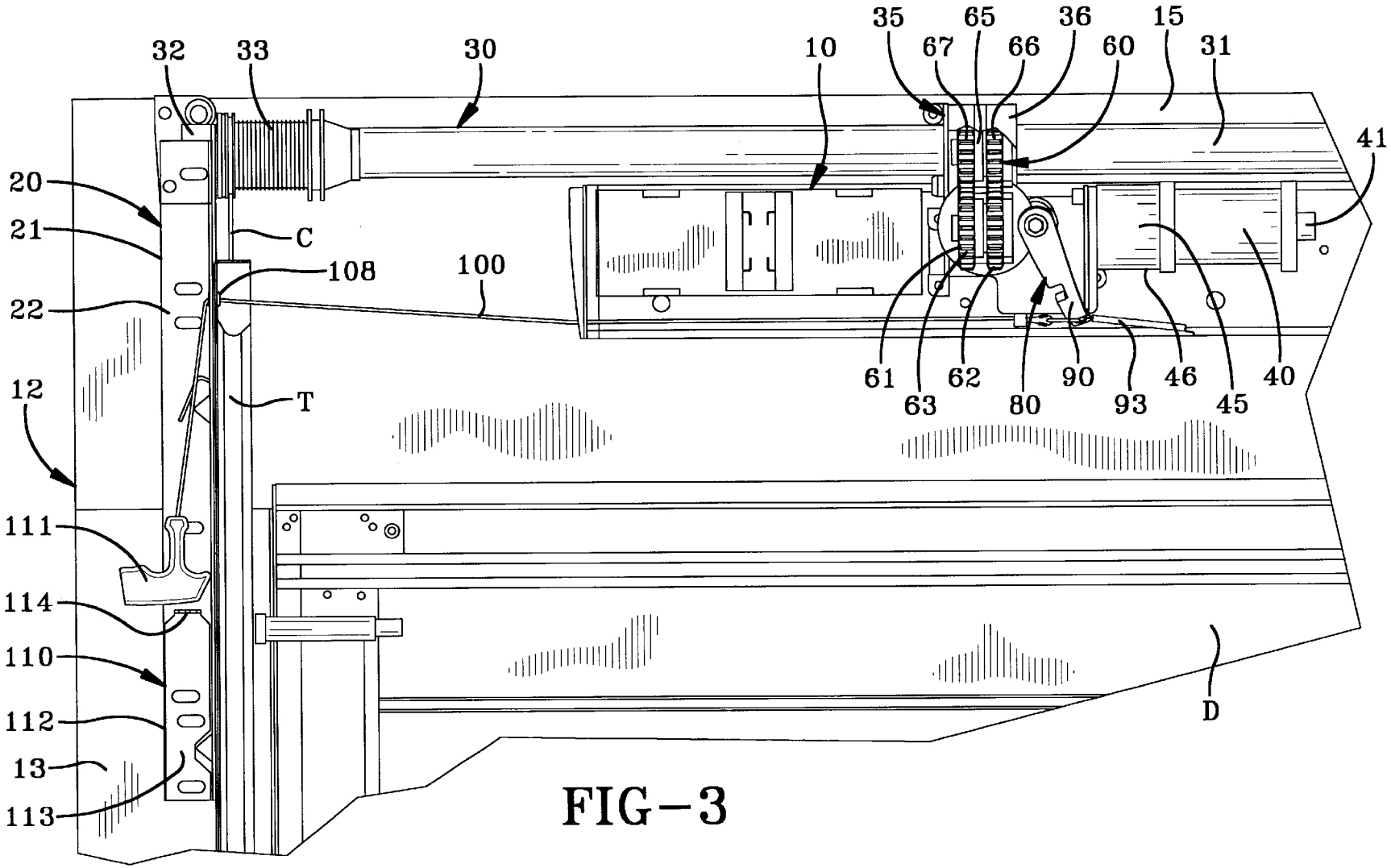
FIG. 3 is a fragmentary rear elevational view similar to FIG. 3 showing the disconnect assembly in its disengaged position for movement of the door independent of the operator.

As seen in the drawing figures, the motorized operator 10 has an operator housing 35 encompassing a portion of the operative components. The operator housing 35 is attached to the header 15 as by a plurality of cap screws (not shown). As seen in FIGS. 1–3, the drive tube 31 of counterbalance system 30 extends through a portion of the housing 35. It is to be appreciated that the motorized operator 10, with the depicted counterbalance system 30, while normally mounted medially of drive tube 31 between cable drum mechanisms 33, could be mounted at any desired location along drive tube 31 should it be necessary or desirable to avoid an overhead or wall obstruction in a particular garage design.

The motorized operator 10 has an operator motor, generally indicated by the numeral 40. The operator motor 40 may be a conventional electric motor that is designed for stop, forward, and reverse rotation of a motor shaft 41 (see FIG. 5). As shown, the motor 40 and motor shaft 41 are in close proximity to drive tube 31 and have their center lines oriented in parallel relation thereto, such as to provide a compact configuration within the operator housing 35 and to simplify interconnection therebetween in the manner described hereinafter. It is to be noted that the operator housing 35 and all components thereof are positioned below the drive tube 31, except for the small portion of housing 35 that encompasses the drive tube 31. As a result, the entire motorized operator 10 essentially resides below and within the envelope defined by the counterbalance system 30 and the tracks T.

In order to provide an operator motor 40 of minimal dimensions and enhanced power output, and to achieve other efficiencies, the operator motor 40 is coupled to a gear reducer 45. The gear reducer 45 has a generally cylindrical housing 46 that is attached to the operator motor 40 in operative relation thereto. The gear reducer 45 is provided with suitable conventional planetary gear arrangements of one or multiple stages to achieve the power and rotational speed requirements for actuating counterbalance system 30. The output of the gear reducer 45 is by way of a drive shaft 50 (see FIGS. 4 and 5), which extends from gear reducer 45 in the direction opposite the operator motor 40. The drive shaft 50 has a hexagonal shaft section, or other non-circular cross section, 51 proximate to the gear reducer 45 and a cylindrical shaft section 52 extending outwardly of the hexagonal shaft section 51. The extremity of drive shaft 50, and particularly cylindrical shaft section 52, is freely rotatably supported in a cylindrical bearing surface 53 formed in the operator housing 35.

Motorized operator 10 is interconnected with counterbalance system 30 and particularly the drive tube 31 thereof by a gear train, generally indicated by the numeral 60. The gear train 60 includes a drive gear 61 which is freely, rotatably mounted on the cylindrical shaft section 52 of drive shaft 50. The drive gear 61 preferably has a pair of axially spaced spur gears 62 and 63 disposed about the circumferential periphery thereof. The gear train 60 further includes a driven gear 65 that is non-relatively rotatably affixed to the drive tube 31 of the counterbalance system 30. The driven gear 65 has a pair of axially spaced circumferentially continuous spur gears 66 and 67 (see FIGS. 2–3) that matingly engage the spur gears 62 and 63, respectively, of the drive gear 61.

It will thus be appreciated that rotation of drive gear 61 of gear train 60 will result in angularly opposite rotation of the driven gear 65 and thus the drive tube 31 of counterbalance system 30 to effect raising and lowering of the door D. In order to protect gear train 60 from dirt or other foreign matter or interference by foreign objects, the operator housing 35 may be provided with a cylindrical extension 36 which encloses the driven gear 65 of the gear train 60.

Figure 4:
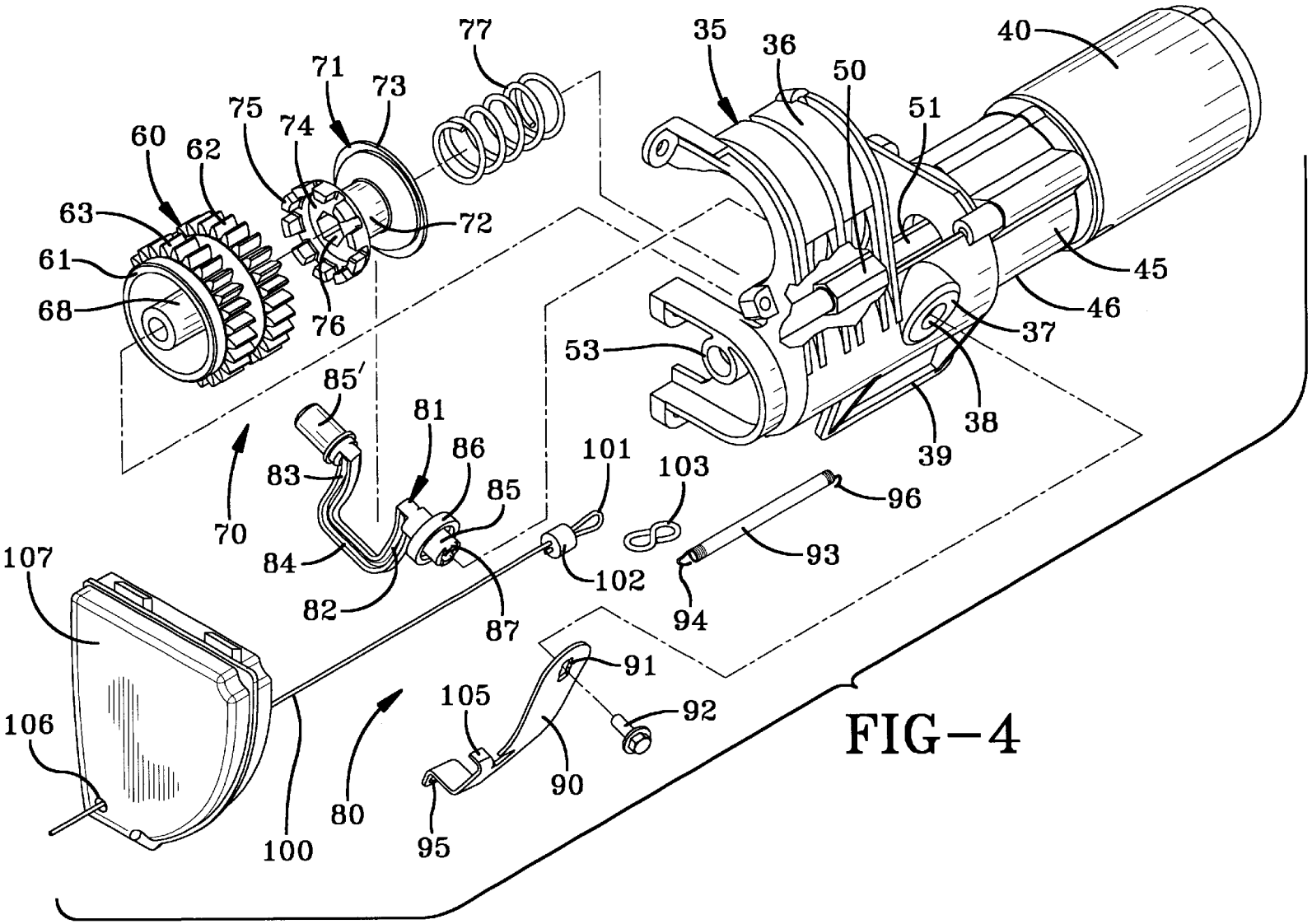
FIG. 4 is an enlarged exploded perspective view taken in the direction of FIG. 1 showing details of the operating parts of the operator and particularly the disconnect assembly.
Figure 5:
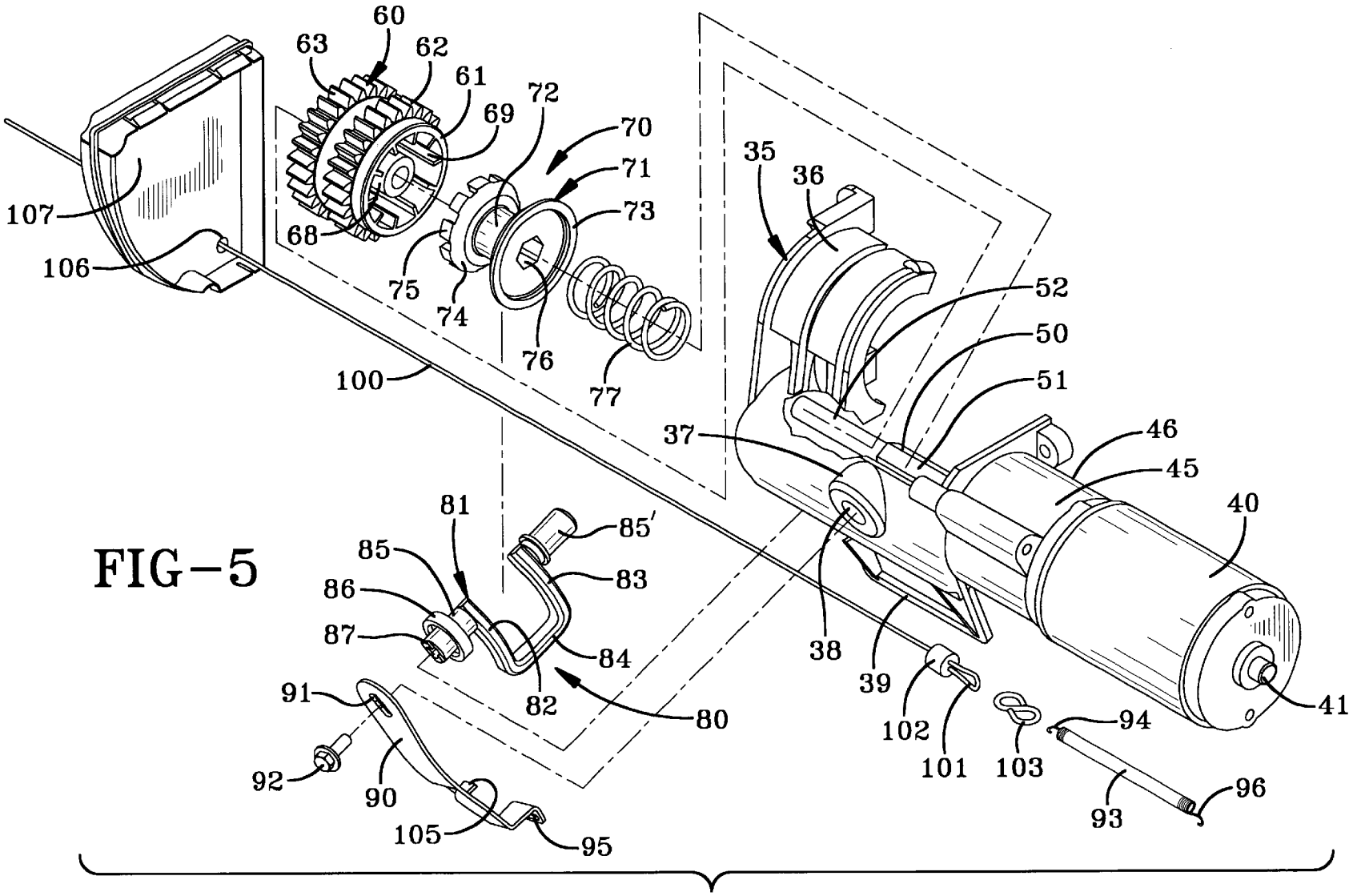
FIG. 5 is an enlarged exploded perspective view similar to FIG. 4 taken from a position proximate the other end of the door and showing further details of the operating parts of the operator and particularly the disconnect assembly.

The drive shaft 50 of motorized operator 10 interrelates with the gear train 60 by way of a disconnect assembly, generally indicated by the numeral 70, as best seen in FIGS. 4 and 5. The disconnect assembly 70 is mounted in operative relation to the drive shaft 50 within operator housing 35 between the gear train 60 and the gear reducer 45.

The disconnect assembly 70 includes a cylindrical spool, generally indicated by the numeral 71. The spool 71 has a central cylindrical recess 72 bounded on one axial extremity by a substantially planar flange 73 and on the other axial extremity by a somewhat arcuate flange 74. The arcuate flange 74 has axially outwardly projecting circumferential teeth 75 which extend in the direction opposite the cylindrical recess 72. The spool 71 has a central through aperture 76 that is sized and configured to matingly engage the hex shaft section 51, or other non-circular cross section, of the drive shaft 50. The aperture 76 is sized and configured in such a manner as to be mounted for rotation with the drive shaft 50 throughout the range of movement of spool 71 along drive shaft 50.

The teeth 75 of arcuate flange 74 of spool 71 are spaced radially outwardly on flange 74 a sufficient distance to lie radially outwardly of a hub 68 of the drive gear 61 which freely rotatably mounts the drive gear 61 on the cylindrical shaft section 52 of drive shaft 50. The teeth 75 are adapted to fit within drive gear 61 and interengage with a plurality of circumferentially spaced splines 69 within the drive gear 61. It will be appreciated that when the spool 71 is in contact with drive gear 61 such that the splines 69 interfit between the teeth 75 of spool 71, the drive gear 61 will rotate with the spool 71 as dictated by the drive shaft 50. A compression spring 77 positioned on drive shaft 50 biasingly engages flange 73 to maintain teeth 75 of spool 71 in operative engagement with splines 69 of drive gear 61.

The positioning of the spool 71 of disconnect assembly 70 is effected by an actuating mechanism, generally indicated by the numeral 80. The actuating mechanism 80 includes a yoke, generally indicated by the numeral 81, which is best seen in FIGS. 4 and 5 of the drawings. The yoke 81 interfits with and operatively positions the spool 71 of the disconnect assembly. In particular, the yoke 81 has a pair of parallel arms 82 and 83 which are joined by a crossbar 84 to form a U-shaped member that fits within the cylindrical recess 72 of spool 71. The arms 82, 83 and crossbar 84 operatively engage the flanges 73 and 74 of the spool 71 to move the spool 71 axially along the hexagonal shaft section 51 of drive shaft 50 to position the spool 71 relative to the drive gear 61.

There is, however, a significant clearance between the yoke 81 and the flanges 73, 74 of spool 71 to permit supplemental movement of the spool 71 independent of the yoke 81 for a purpose hereinafter described. The actuation of spool 71 by yoke 81 is effected by the pivotal mounting of yoke 81 within the operator housing 35. The pivotal mounting of the yoke 81 is effected by stub shafts 85 and 85' that extend from the extremities of the arms 82 and 83, respectively, opposite the crossbar 84. The stub shaft 85 has a boss 86 that seats in a bearing protrusion 37 in operator housing 35, which has a bore 38 through which the stub shaft 85 protrudes outwardly of the operator housing 35. The stub shaft 85' is mounted in a bearing surface (not shown) in the operator housing 35 such as to orient the yoke 81 for pivotal motion in a plurality of planes substantially perpendicular to drive shaft 50 while remaining within the cylindrical recess 72 between the flanges 73, 74 of spool 71.

The selective pivoting of yoke 81 to position spool 71 is effected by a control arm 90. The control arm 90 has an elongate slot 91 that receives diametrically opposed projections 87 on the stub shaft 85 to thus non-rotatably affix control arm 90 to the yoke 81. A screw 92, or other appropriate fastener, threads into the end of stub shaft 85 to maintain control arm 90 positioned thereon and thus maintain yoke 81 in position axially of the stub shafts 85, 85'. The control arm 90 is biased counterclockwise to the position depicted in FIG. 3 of the drawings by a tension spring 93. The tension spring 93 has a hook 94 at one end thereof, which engages an aperture 95 in control arm 90, and a hook 96 that is attached to a hole (not shown) or is otherwise secured in the operator housing 35.

Countering the force supplied by tension spring 93, the control arm 90 has a control cable 100 extending from control arm 90 in the direction opposite the tension spring 93. As shown, the cable 100 has a loop 101 formed at the extremity thereof by a an attached cable clamp 102. An S-hook 103 connects the loop 101 to the aperture 95 at the lower extremity of the control arm 90. An in-tuned tab 105 on control arm 90 engages a stop 39 formed in the operator housing 35 to limit clockwise rotation of the control arm 90, as viewed in FIGS. 2 and 3 of the drawings.

In order to provide for operation of the actuating mechanism 80 when the door D is in a partially open condition and to displace the operating station from a position above the door D to the side of door D or other remote location, the cable 100 extends to a control station, generally indicated by the numeral 110, as seen in FIGS. 1 and 2. As shown, the cable 100 extends through an aperture 106 in the end cap 107 of the operator housing 35 and along the header 15 above the door D. Thereafter, cable 100 may be directed through a bushing 108 in the flag angle 20 and diverted downwardly to the control station 110. The cable 100 terminates in a permanently affixed operator handle at the control station 110. An L-shaped retaining bracket 112 selectively secures and releases the operator handle 111. The retaining bracket 112 has a vertical leg 113, which may be attached to frame 12 of the door D, as best seen in FIG. 1. A horizontal leg 114 of the retaining bracket 112 has a slot 115 for receiving the cable 100 and achieving elective retention and release of the cable 100, as seen in FIG. 2 and FIG. 3, respectively.

In the normal operation of motor operator 10, the cable 100 is tensioned by retention of operator handle 111 in the retaining bracket 112, as seen in FIG. 2 of the drawings. In this position, the control arm 90 is at the limit of its clockwise travel, with the tab 105 being in engagement with stop 39 of operator housing 35. The spool 71 of disconnect assembly 70 is maintained with the teeth 75 in operative engagement with splines 69 of drive gear 61 due to the biasing force provided by compression spring 77. The drive tube 31 of counterbalance system 30 is thus selectively directionally rotated and stopped by the gear train 60, as actuated by operator motor 40, based upon motor control signals, which are supplied to operator motor 40 in a conventional manner. Depending upon design considerations, it may be necessary or desirable to provide motor control signals which reverse the motor for a short interval when the door D is stopped during closing. This reversal reduces torsional loading that may otherwise exist between the spool 71 and the drive gear 61 to facilitate the axial separation of these elements in the event of subsequent operation of disconnect assembly 70.

In the event the door D encounters an obstruction or power is lost to the operator motor 40, the door D may be disconnected from the operator 10 for independent manual movement by actuation of disconnect assembly 70, as controlled by its actuating mechanism 80. This action is initiated by releasing the operator handle 111 from the retaining bracket 112 to free the cable 100, such that the tension spring 93 of the actuating mechanism 80 moves the control arm 90 to the disengaged position depicted in FIG. 3 of the drawings. This, in turn, pivots the yoke 81 to move the spool 71, and particularly the teeth 75, out of engagement with the drive gear 61, while at the same time compressing the spring 77. In this respect, it is significant to note that the characteristics of spring 93 and spring 77 must be designed so that spring 77 has a lesser spring rate and is thus overcome by the force developed by spring 93 to effect the requisite compression of spring 77. It is significant to note that once handle 111 is released, the disconnect assembly 70 remains in the position with spool 71 disengaged from drive gear 61, without the necessity for manually maintaining tension on the cable 100 via the handle 111. Therefore, this condition of motorized operator 10 is automatically maintained, and the door D may be manually manipulated as necessary by a person who has released the operator handle 111.

Once an obstruction is cleared, power is resumed to motor 40, or it is otherwise desired to connect the door D to motorized operator 10, normal operation may be resumed with the door D at any position by merely grasping the operator handle 111 in the FIG. 3 position and tensioning the cable 100 by pulling downwardly and inserting the cable 100 in the slot 115 of horizontal leg 114 of retaining bracket 112. This selective tensioning of cable 100 returns control arm 90 to the FIG. 2 position, where the tab 105 engages the stop 39, which again tensions the spring 93. The yoke 81 of actuating mechanism 80 rotates with the control arm 90 to move the spool 71 of disconnect assembly 70, such that teeth 75 are in close proximity to, but not in engagement with, the splines 69 of drive gear 61 of gear train 60. At that position, sufficient clearance is present between the yoke 81 and the flanges 73, 74 of spool 71, such that the spring 77 moves the spool 71 further axially of drive shaft 50 so that the teeth 75 of spool 71 move into mating engagement with the splines 69 of drive gear 61. With the spring 77 providing the force effecting engagement of teeth 75 of spool 71 with spline 69 of drive gear 61 rather than the tensioning force of the cable 100, there is a reduced engaging force that minimizes wear or damage to teeth 75 and/or splines 69 during the mating engagement thereof. Once engaged, the spring 77 maintains the spool 71 in the engaged position, as previously indicated.

Thus, it should be evident that the disconnect for powered sectional doors disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. An operator system for moving in upward and downward directions a sectional door comprising, a door, a counterbalancing system including a drive tube interconnected with said door, a reversible motor, a drive shaft selectively driven in two directions by said motor, a drive gear freely rotatably mounted on said drive shaft, a driven gear mounted on said drive tube and operatively engaging said drive gear, a disconnect assembly having a spool rotatable with said drive shaft and movable into and out of engagement with said drive gear for selectively connecting and disconnecting said motor and said drive tube, and an actuating mechanism maintaining said spool normally biased into engagement with said drive gear and biasing said spool out of engagement with said drive gear when released to permit independent movement of said door.

2. An operator according to claim 1, wherein said spool of said disconnect assembly has teeth for selectively interengaging splines on said drive gear.

3. An operator according to claim 2, wherein said gear teeth on said spool project substantially axially outwardly from a flange.

4. An operator according to claim 1, wherein said actuator mechanism includes a pivotally mounted yoke engaging a recess in said spool, wherein selective pivotal movement of said yoke moves said spool axially along said drive shaft relative to said drive gear.

5. An operator according to claim 4, wherein a spring biases said spool into driving engagement with said drive gear.

6. An operator according to claim 5, wherein said spring is a compression spring mounted on said drive shaft and engaging said spool.

7. An operator according to claim 4, wherein said actuator mechanism includes a control arm nonrotatably affixed to said yoke.

8. An operator according to claim 1, wherein said actuating mechanism has a spring biasing said spool out of engagement with said drive gear.

9. An operator according to claim 7, wherein said spring is a tension spring.

10. An operator according to claim 1, wherein said disconnect assembly includes a first spring for biasing said spool into engagement with said drive gear and said actuating mechanism has a yoke for moving said spool between a position proximate to said drive gear and a position out of engagement with said drive gear and a second spring biasing said spool out of engagement with said drive gear.

11. An operator according to claim 10, wherein said first spring has a lesser spring rate than said second spring.

12. An operator according to claim 10, wherein said yoke has a control arm which is connected by a cable to a control station which normally tensions said cable to maintain said spool in engagement with said drive gear and which permits said second spring to bias said spool out of engagement with said drive gear when tension on said cable is released at said control station.

13. An operator according to claim 12, wherein said second spring is attached to said control arm.

14. An operator according to claim 12, wherein said control arm has a tab that engages a stop when said spool is moved to said position proximate to said drive gear.

15. An operator system for moving in upward and downward directions a sectional door comprising, a door, a counterbalancing system including a drive tube interconnected with said door, a reversible motor, a drive shaft selectively driven in two directions by said motor, a drive gear freely rotatably mounted on said drive shaft, a driven gear mounted on said drive tube and operatively engaging said drive gear, disconnect means having a spool rotatable with said drive shaft and movable into and out of engagement with said drive gear for selectively connecting and disconnecting said motor and said drive tube, and actuating means normally maintaining said spool in engagement with said drive gear and biasing said spool out of engagement with said drive gear when released to permit independent movement of the door.

16. An operator according to claim 15, wherein said disconnect means includes a spool having teeth for selectively interengaging splines on said drive gear.

17. An operator according to claim 16, wherein said disconnect means includes a first spring for biasing said spool into engagement with said drive gear and said actuating means has a yoke for moving said spool between a position proximate to said drive gear and a position out of engagement with said drive gear and a second spring biasing said spool out of engagement with said drive gear.

18. An operator according to claim 17, wherein said yoke has a control arm which is connected by a cable to a control station which normally tensions said cable to maintain said spool in engagement with drive gear and which permits said second spring to bias said spool out of engagement with said drive gear when tension on said cable is released at said control station.

19. An operator system for moving a sectional door in upward and downward directions comprising, a door, a counterbalancing system including a drive tube interconnected with said door, a motor, a drive shaft selectively driven in two directions by said motor, a drive gear freely rotatably mounted on said drive shaft, a driven gear mounted on said drive tube and operatively engaging said drive gear, a disconnect having a spool rotatable with said drive shaft and movable into and out of engagement with said drive gear for selectively connecting and disconnecting said motor and said drive tube, and an actuator normally maintaining said spool in engagement with said drive gear and biasing said spool out of engagement with said drive gear when released to permit independent movement of said door.

20. An operator according to claim 19, wherein said disconnect comprises a spool having teeth for selectively interengaging said drive gear.

21. An operator according to claim 19, wherein said actuator includes a pivotally mounted yoke engaging a recess in said spool, wherein selective pivotal movement of said yoke moves said spool axially along said drive shaft relative to said drive gear.

22. An operator according to claim 19, wherein said disconnect includes a first spring for biasing said spool into engagement with said drive gear and said actuator has a yoke for moving said spool between a position proximate to said drive gear and a position out of engagement with said drive gear and a second spring biasing said spool out of engagement with said drive gear.

23. An operator according to claim 19, wherein said actuator includes a cable which is tensioned to maintain said spool in engagement with said drive gear, whereby further tensioning of said cable reinforces the engagement of said spool with said drive gear.

24. An operator according to claim 19, wherein a motor control signal is provided to said motor to reverse said motor for a short interval when the door is stopped during closing, thereby reducing torsional loading between said spool and said drive gear to facilitate separation of said spool from said drive gear during release of said actuator.

* * * * *